United States Patent [19]

Vossen et al.

[11] 4,243,166

[45] Jan. 6, 1981

[54] METHOD FOR SEPARATING AND STACKING SHEETS OF PAPER AND THE LIKE

[75] Inventors: Franz Vossen, Brüggen; Georg M. Vossen, Niederkrüchten, both of Fed. Rep. of Germany

[73] Assignee: Wupa-Maschinenfabrik GmbH, Fed. Rep. of Germany

[21] Appl. No.: 49,550

[22] Filed: Jun. 18, 1979

Related U.S. Application Data

[62] Division of Ser. No. 805,418, Jun. 10, 1977, Pat. No. 4,171,081.

[30] Foreign Application Priority Data

Jun. 14, 1976 [DE] Fed. Rep. of Germany ..... 2626630
Jul. 3, 1976 [DE] Fed. Rep. of Germany ..... 2630094

[51] Int. Cl.[3] ..... B26F 3/02

[52] U.S. Cl. ..... 225/1; 83/29; 83/103; 493/344; 225/2; 225/94; 225/97; 493/372

[58] Field of Search ..... 225/1, 2, 94, 101, 106, 225/97; 83/29, 91, 93, 94, 92, 96, 103; 93/36 A

[56] References Cited

U.S. PATENT DOCUMENTS

| | | | |
|---|---|---|---|
| 2,413,999 | 1/1947 | Shaner | 83/103 |
| 2,958,431 | 11/1960 | Curtenius | 83/91 X |
| 3,794,228 | 2/1974 | Colwill et al. | 225/101 X |
| 4,041,847 | 8/1977 | Spengler | 83/103 X |

*Primary Examiner*—Frank T. Yost
*Attorney, Agent, or Firm*—Lerner, David, Littenberg & Samuel

[57] ABSTRACT

Methods for separating and stacking sheets of paper, cardboard and the like delivered from sheet punching machines and consisting of useful and waste portions connected together by small fillets are disclosed. The methods include supplying punched but unseparated sheets onto a severing table, severing the sheets in order to form separate stack portions and depositing these separate stack portions onto a stacking surface after withdrawing the severing table from under the stacked portions.

12 Claims, 4 Drawing Figures

METHOD FOR SEPARATING AND STACKING SHEETS OF PAPER AND THE LIKE

This is a division, of application Ser. No. 805,418, filed June 10, 1977 now U.S. Pat. No. 4,171,081 which issued on Oct. 16, 1979.

The invention relates to a method of separating and stacking sheets of paper, cardboard and the like, which are delivered from a sheet punching machine and consist of useful and waste portions connected together by small fillets, as well as an apparatus for carrying out the method.

Especially in the packaging industry the punched portions required for production of the packagings are produced in the manner that the required useful portions are punched out of large sheets of paper, cardboard and the like, one sheet possibly comprising an integral number of useful portions. In order that disorders, through useful or waste portions dropping out, do not occur on subsequent movement of the sheets out of the sheet-punching machine, small fillets are left between the individual useful portions and/or waste portions, so that the sheet can be progressed as a whole. Before, however, the individual useful portions can be supplied to their useful application, the useful and waste portions must be separated from one another. Separating equipment for this purpose is shown, for example, in West German patent specification No. 2,310,021, as published for inspection. In this known arrangement punched sheets of this kind are directed into a separating unit and there separated both longitudinally and transversely. Subsequently the separated useful portions are stacked on a pallet. There is also the possibility of disposing several stacks on top of one another, an unpunched sheet being inserted between the individual stacks for stabilization.

The known arrangement has various disadvantages. One of these is that the possibility of separation is restricted to longitudinal and transverse separation, so that complicated shapes can be separated only with difficulty. A further disadvantage resides in the fact that separating and stacking take place in different stations, so that there is a very large overall length. Both the separating equipment and the stacking equipment are of very complicated construction, which makes the apparatus not only expensive, but especially also susceptible to trouble. Considerable difficulties are involved for the same reason in re-arranging the apparatus for a different punched shape.

The known apparatus has yet the further disadvantage that, for moving the completed stack out, the supply of punched sheets and thus also the stamping equipment must be stopped for a long time. Because of this the number of sheets which can be punched and stacked per hour is reduced.

In the West German patent specification No. 2,404,840, as published for inspection, there is described a finger-like tool with which it is possible to separate from one another the useful portions of a sheet lying on a smooth separating surface in the manner that, on putting the fingers on two useful portions to be separated, further downwards pressure spreads the fingers apart from one another and hence the connecting fillets between the useful portions are destroyed.

The problem with which the invention is concerned is to provide a method of separating and stacking punched sheets of paper, cardboard and the like in which the relatively long stoppage time of the known method can be reduced and in which moreover substantially less space is necessary for carrying out the method.

According to the invention, a method of separating and stacking sheets of paper, cardboard and the like, which are delivered from a sheet punching machine and consist of useful and waste portions connected together by small fillets, comprises the steps of (a) laying and separating a specific number of sheets on a severing table of a useful portion separating station;
(b) interrupting the supply of sheets;
(c) lowering the table with a stack of separated sheets;
(d) withdrawing the table from under the stack and laying the stack on a pallet situated therebelow;
(f) setting the table in place and raising same;
(g) removing the pallet with the stack and introducing a new pallet with simultaneous continuation of the procedure in method step (a).

The saving in time is achieved especially because of the fact that the supply of punched sheets needs to be interrupted for only a very short time. In particular there is not involved the stoppage time for the punching machine necessary according to the state of the art while the completed stack is being taken away, as, according to the invention, during the time while the full pallet is moved away and a new empty pallet is introduced, the sheets accumulating in the interim can be stacked on an intermediate carrier (namely the severing table). The saving in space results from the stacking and separating occurring at the same station.

Moreover, it is possible in a simple manner with the improved method according to the invention to increase, by interpositioning of unpunched sheets, the stability of the stack formed from punched sheets. For that purpose an unpunched sheet may be disposed either only on the underside of the stack and/or the upper side of the stack, or unpunched sheets be also interposed between individual stack sections to further increase the stability.

The invention also relates to an apparatus for separating and stacking sheets of paper, cardboard and the like, which are delivered from a sheet punching machine and consist of useful and waste portions connected together by small fillets, comprising a supply device upstream of a sheet-punching machine for supplying punched, but not yet separated, sheets on to a plane severing surface, severing tools movable upwards and downwards on linkages and arranged above the plane supporting surface, and a plane stacking surface for taking up the stack of separated sheets, the plane severing surface being formed by a severing table or the uppermost sheet of a stack of sheets lying on the severing table, the severing table being adjustable in height, the plane stacking surface being formed by a pallet, means for moving the pallet into and from below the severing table and said pallet being adjustable in height, and a device for lateral displacement of the severing table and holding back the stack of sheets in a position lying outside the limits of the pallet and for putting the severing table again into position above the stack of sheets.

In the case of the apparatus according to the invention the problem of the invention may be solved by the fact that the plane separating surface is formed by a severing table or the uppermost sheet of a stack of sheets situated on the severing table, that the severing table is adjustable in height, that the plane stacking surface is formed by a pallet which can move into and from a position below the severing table, and that there is provided equipment for moving the severing table laterally while holding back the stack of sheets in a position situated outside the area of the pallet and for moving the table back again above the stack of sheets. With this apparatus, therefore, stacking and separating take place at the same station so that there is a saving in space. With the apparatus according to the invention, moreover, punching and separating can also be effected while a filled pallet is moved away and a new empty pallet introduced.

A supporting ledge preferably serves to prevent possible tipping of the stack on retraction of the severing table. At least one supplementary ledge or supporting panel may extend upwardly and be connected with the first-mentioned ledge. At least one hold-back ledge or panel may be disposed at the side of the range of outwards movement.

Preferably the pallet is disposed on a pallet carrier so that it is not necessary to introduce the pallet directly into the machine, for example with a fork-lift.

In order to insert into the stack the unpunched sheets supporting the stack of separated sheets, there may be provided a suction device adapted to raise above the upper surface of the separating table the uppermost sheet of a stack of unpunched sheets lying below the undersurface of the severing table, before the latter moves outwards, and to release the raised sheet when the severing table is below the sheet. This suction device may be adapted to raise only that edge of the sheet below which the severing table first penetrates on its outwards movement. The suction device may be adapted to be swung away together with the hold-back ledge(s) or panel(s).

These facilities as also the supporting panel can be swung away, whereby the range of use of the apparatus is widened.

Advantageously the various parts of the apparatus can be adjusted in such a way that different sizes of sheet can be handled.

The apparatus is particularly suitable for the severing tools described in West German patent specification No. 2,404,840 as published for inspection, which tools can sever even very complicated punched lines, as no space-occupying lower tools are necessary. In addition to the spreader fingers it is preferable to provide severing teeth for cutting off the edge area (especially the gripping margin) and to arrange holding stamps for supporting large-area parts of the sheets.

Further objects, features, and advantages of the present invention will become apparent upon the consideration of the following detailed description of a presently-preferred embodiment when taken in conjunction with the accompanying drawings, wherein.

Figure 1:
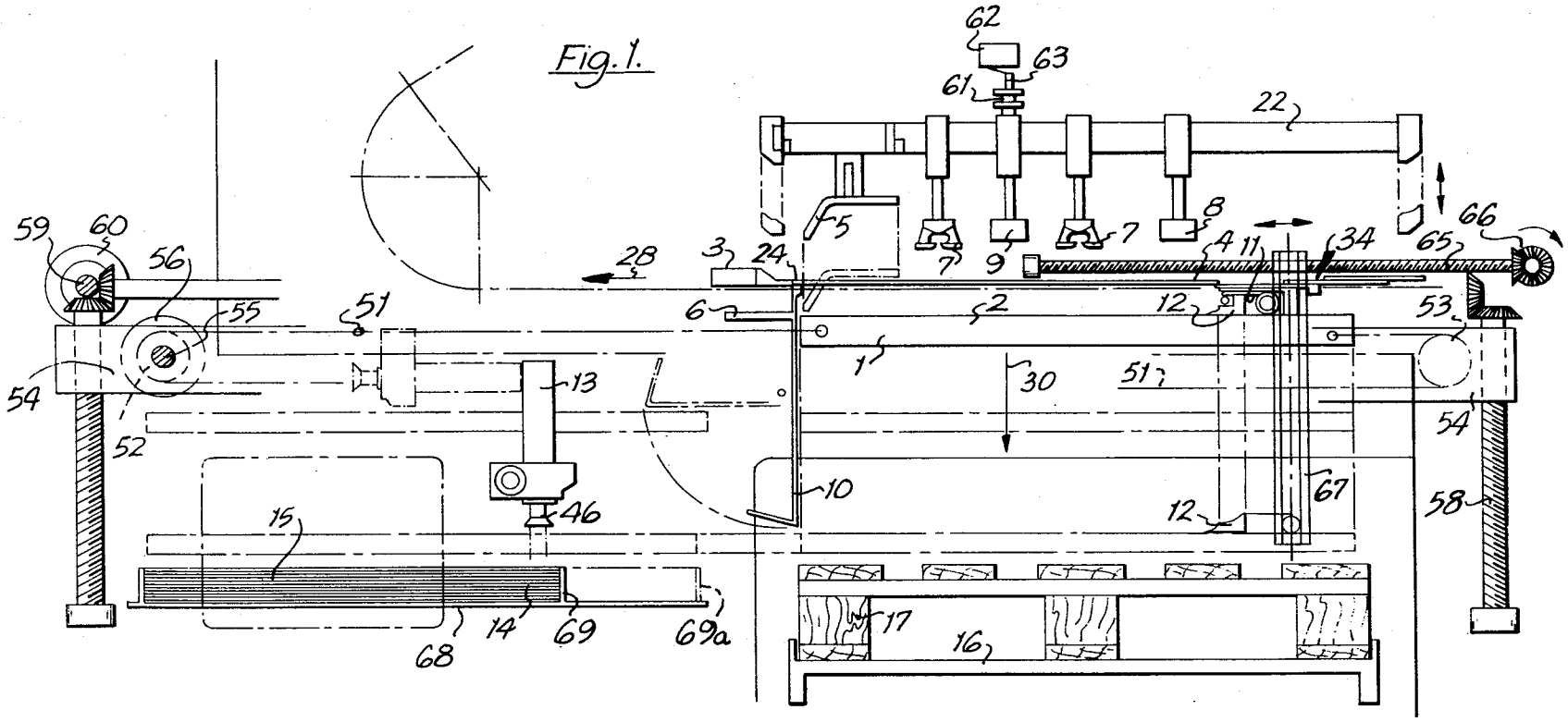
FIG. 1 is a side elevational view of the stacking and separating apparatus embodying the present invention.

In FIG. 1 there is shown a severing table 1 on which already lies a sheet 2 of paper or cardboard or similar material which is or is not punched. A punched sheet 4 to be separated of paper, cardboard and the like is pulled by means of a gripping device 3 from a sheet-punching machine, not shown, over the severing table 1, the sheet being exactly aligned by the gripping device with regard to the severing station.

A gripping device suitable for this purpose is described, for example, in West German patent specification No. 2,520,231 (as published to inspection), while there is disclosed in West German patent specification No. 2,520,232 (as published for inspection and likewise originating from the applicants) a device by means of which a sheet can be delivered over to a gripping device of that kind. A precise description of these components will not therefore be given herein.

Above the severing table there is a rod 22 moving up and down, a severing tooth 5 being rigidly secured on the one hand to the rod 22 and spreader fingers 7, a holding stamp 8 and a pressure-sensing element 9 being adjustably secured to the rod 22. Device, which make use of severing teeth like the tooth 5, are disclosed in the Applicants' British patent application No. 33022/76 dated Aug. 9, 1976, U.S. patent application Ser. No. 711,464 dated Aug. 4, 1976, and Japanese patent application No. 94,418/76 dated Aug. 12, 1976, while spreader fingers are described in the already-mentioned German patent specification No. 2,404,840 (as published for inspection and going back to the applicants). In this state of affairs also, a precise description of these machine parts can therefore be waived.

The arrangement so far described serves to separate the sheet 4 supplied by the gripping device 3, as on the rod 22 going downwards, the severing tooth 5 severs the sheet from the supporting margin 24 which is clamped in the gripping device 3, so that the sheet 4 is placed on the surface of the severing table 1 or a sheet or stack of sheets lying on the severing table. On the rod 22 going further downwards the bearing surfaces of the spreader fingers 7, the holding stamp 8 and the pressure-sensing element 9 are in contact with the different useful and scrap parts. On further downwards movement the fingers 7, which are arranged above a punched line to be severed, are forced apart from one another and thereby break the fillets still connecting these useful parts together, so that on the subsequent downwards movement of the rod 22 a separated sheet remains behind on the severing surface. During the upwards movement of the rod 22 the gripping device 3, which is secured, for example, to revolving holding chains (not shown) travels further along its path of motion in the direction of the arrow 28 in order to clear the way for further gripping devices (not shown) with further punched sheets and return to the sheet-punching machine, and after release of the supporting margin 24 at a suitable point, seize a new sheet at its supporting margin in the sheet punching machine.

In order that the level of the plane surface, on which the sheet 4 at any time delivered from the gripping device 3 is separated, is maintained constant, the severing table 1 moves downwards as the height of the stack increases, see the arrow 30. This downwards movement of the severing table 1 may be effected, for example, by means of hydraulic appliances, but even through jacks or like appliances, the control of the level of the severing table possibly being effected, for example, by means of a sensing element 9 which ascertains the applied pressure and keeps same at a determined value through appropriate adjustment of the height of the severing table.

Sensing element 9 operates in the following manner. Its upper end includes nuts 61 which are manually adjustable, a sensing element 63, and a switch 62 which is electrically connected to a driving gear 60. In operation, after a couple of sheets 2 have been placed onto severing table 1, the distance between the surface of the uppermost sheet 2 and the pressure sensing element 9 is decreased. The decreased distance results in a higher pressure acting on the element 9 during downward movement of the rod 22. The increased pressure causes a slight upward movement of the element 9 with respect to the rod 22, which may be affected by some spring means between rod 22 and element 9, and this produces an upward movement of the nut 61 and the sensing element 63 which operates to close switch 62 for a short period of time. During this time, switch 62 causes the operation of driving gear 60 to lower severing table 1, until the pressure sensed by element 9 decreases and switch 62 opens.

Figure 2:
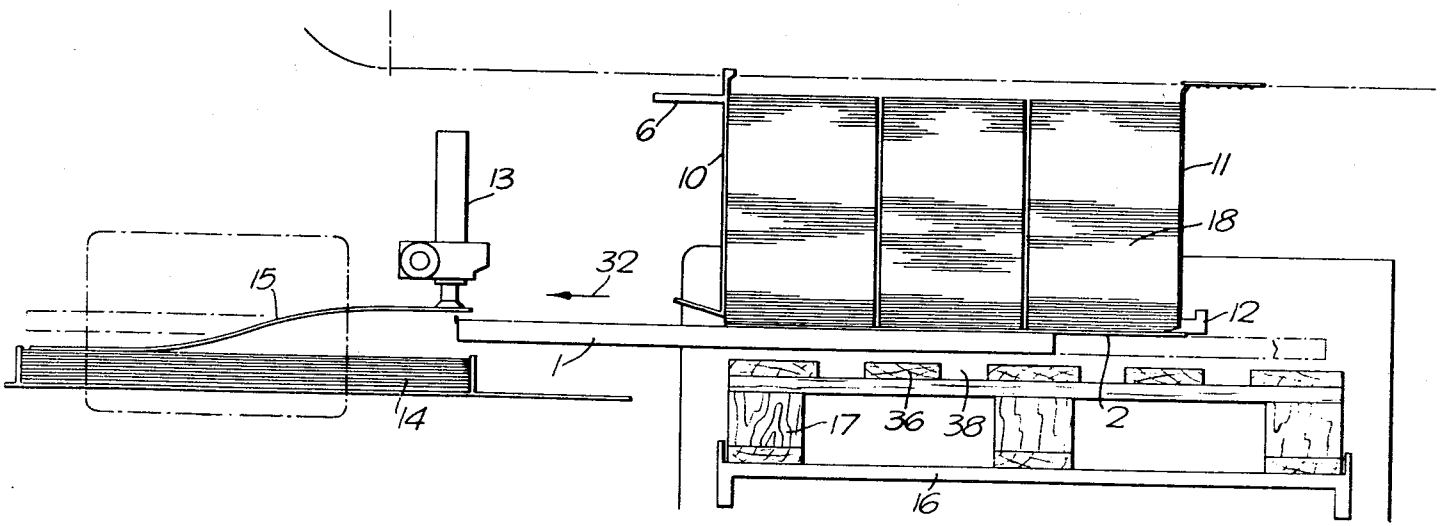
FIG. 2 is also a side elevational view illustrating the apparatus after a stack has been formed and illustrating the severing table being withdrawn to its first position.

The severing table 1 is therefore not directly controlled from, for example, the jacks, as to its height, but through a guide (not shown) which makes it possible to move the severing table 1 also horizontally, especially to draw it out to the left, as is indicated by the arrow 32 in FIG. 2.

Any suitable apparatus may be provided for displacing severing table 1 laterally to the left. For example, as shown in FIG. 1, severing table 1 may be connected at each of its ends to a chain 51, which is rotatably mounted on chain wheels 52 and 53. The chain wheels are supported by a beam 54, which beam also has guiding elements for guiding the movement of table 1. The chain wheel 52 is connected to a shaft 55, which shaft is driven by a suitable gearing arrangement 56 to effect the lateral movement of the table 1 between the solid-line and dotted-line positions shown in FIG. 1. In addition, the beam 54 is supported at its corners by four threaded vertical spindles, two of which, 57 and 58, are shown in the drawings. Each of these spindles is connected by beveled gears to a shaft 59, which shaft is driven by driving gear arrangement 60. As a result, rotation of the spindles produces vertical movement of the beam 54 and thereby vertical movement of severing table 1 connected thereto.

This outwards movement of the severing table 1 is effected as soon as a determined number of sheets have been stacked or as soon as the stack 18 formed from these sheets has reached a definite height. Before the severing table 1 is moved outwards, however, after the determined number of sheets or the definite height of the stack 18 has been achieved, the supply of further sheets from the sheet-punching machine is interrupted—that is to say, the sheet-punching machine is stopped for a short time—, and the severing table 1 is further lowered by a determined amount to the level represented in FIG. 2.

Thereafter the severing table 1 travels to the left (see FIG. 2) in its guide (not shown), whereby the stack 18 is held back by a hold-back panel 10, which may also take the form of one or more hold-back strips. Below the severing table 1 shifting to the left, there is a pallet 17, for example a conventional European pallet, which rests on a pallet carrier 16. In order that the stack 18 of sheets, which consists of several individual stacks, does not tip or is not displaced, it is preferable to provide a ledge 12 which holds the right-hand edge of the stack 18 at the level of the upper side of the severing table 1. A supplementary panel 11 connected with the ledge 12 may also serve for further support of the stack, see especially FIG. 3.

Through the configuration of the ledge 12 the stack of sheets is deflected inwardly and downwardly in the zone of the surface becoming free on the severing table being withdrawn, so that the individual portions of the stack support one another. Not until the severing table still supports only the last centimeters of the left-hand edge of the stack 18 are the severing table 1 and the ledge 12 simultaneously removed, so that the entire stack is thenceforth supported on the pallet 17.

Figure 3:
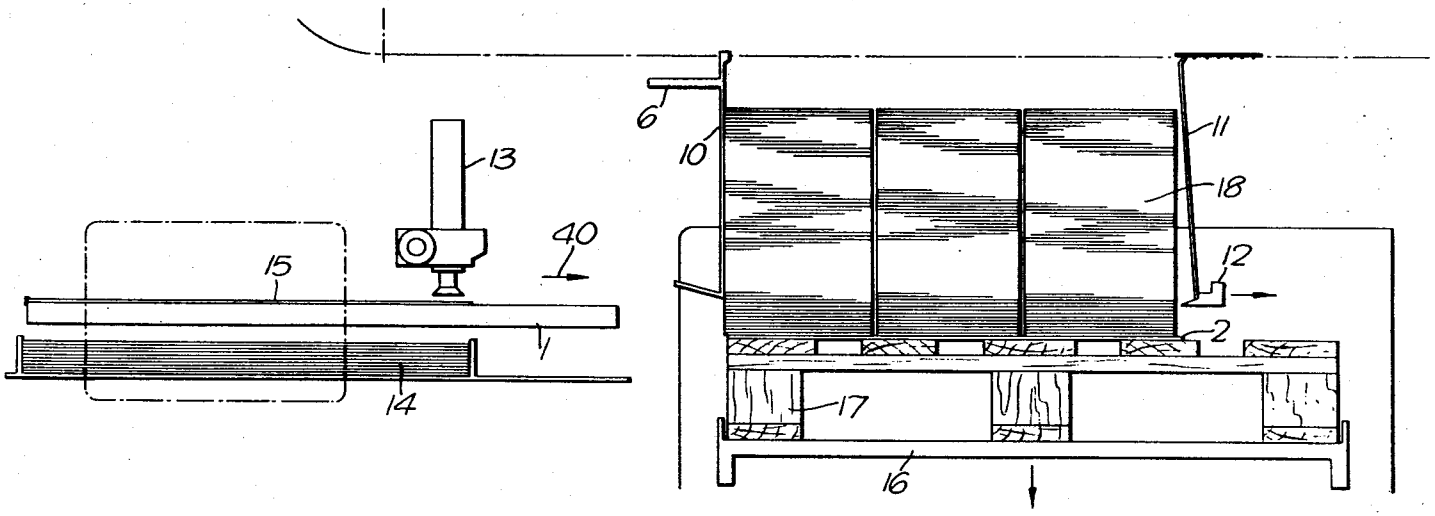
FIG. 3 is a side elevational view illustrating the stack being deposited on a pallet in accordance with the present invention.

There is also shown in FIG. 1 elements for causing the vertical movement of ledge 12. This includes a horizontally disposed spindle 65 which is driven by a beveled gear 66, which may be driven by a suitable driving gear arrangement. The spindle 65 is threaded and carries a vertically disposed rod 67 which may be moved in either direction by the threads on spindle 65. Spindle 65 and rod 67 are supported and guided by beam 54, so that these elements are moved with the beam 54, that is, simultaneously with the vertical movement of severing table 1. Accordingly, spindle 65 operates to move ledge 12 away from the stack, as shown in FIG. 3. Spindle 65 also provides a manner for adjusting the apparatus to receiving sheets of different widths.

Through the disposition of the already-mentioned sheet 2 which is preferably not punched and which to be sure is not absolutely necessary, there is a further stabilizing of the stack 18 of sheets which consists of several stack portions, which is particularly important when the pallet does not have a smooth surface, but has a supporting surface made up of spaced individual boards 36 with spaces 38 which are possibly greater than the width of the narrowest stack portion.

After the stack 18 is laid on the pallet 17, the pallet 17 can be withdrawn from the apparatus either by means of conventional equipment, for example fork-lift truck type conveyances, or the pallet carrier 16 itself is designed to be movable and can be driven out together with the pallet 17. In the course of supplying a new pallet 17, the severing table is again driven in, see arrow 40 in FIG. 3, and the ledge 12 removed for the purpose of letting the stack down (see FIG. 3) is again arranged in its original position at the surface of the severing table 1 (see arrow 42, FIG. 4) and together with the severing table 1 is again moved upwards, see arrow 44 in FIG. 4.

Figure 4:
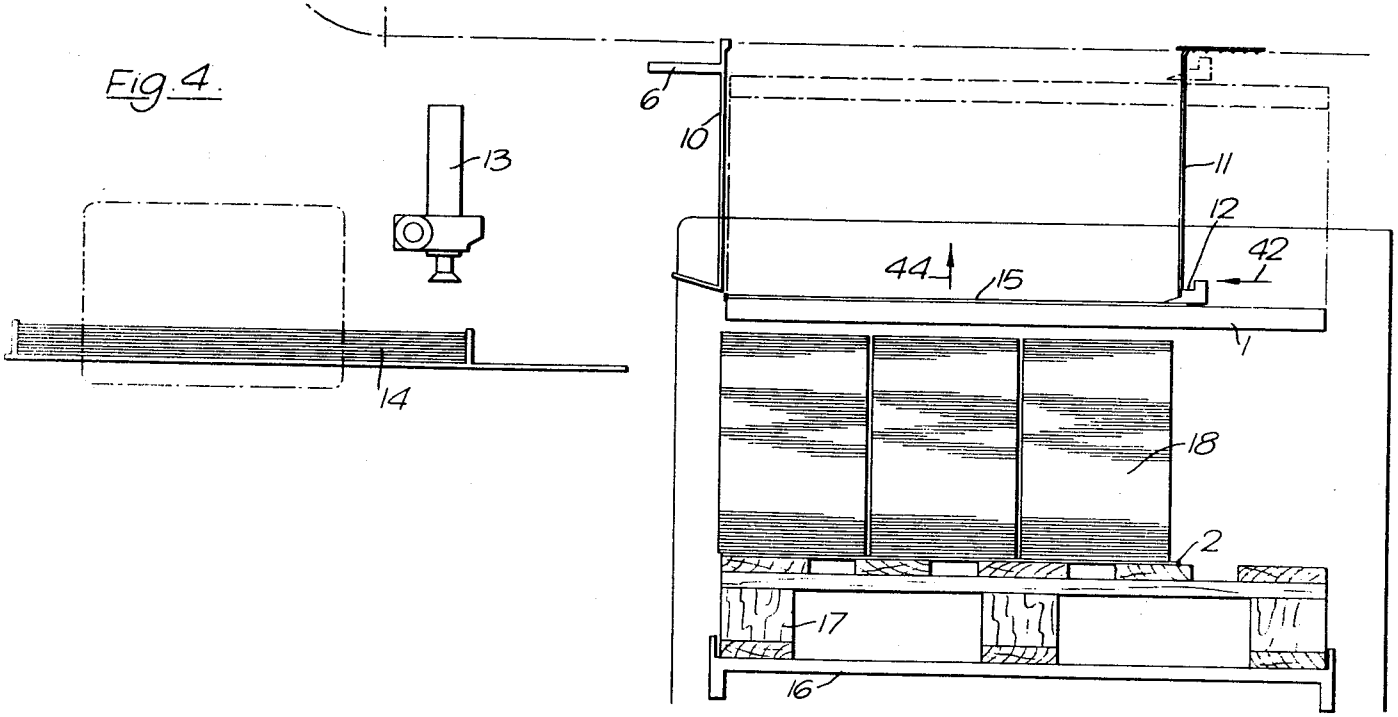
FIG. 4 is a side elevational view illustrating the severing table in position ready to receive the next stack of sheets.

The pallet 16 may be so constructed that it can also be lowered, so that it is not absolutely necessary to drive away the pallet 17 with the stacks 18. Instead of this both pallet and stack 18 could then be lowered until the severing table can be driven in again above the stack, as is shown in FIG. 4.

The possibility of doing this is significant if several unpunched sheets are to be fitted in for supporting the stack. To this end there serves a special set up which in the illustrated embodiment consists of a spare stack 14 of unpunched sheets and a suction device 13. The suction device 13 includes a piston 46 which is lowered to the uppermost sheet 15 of the stack 14 of unpunched sheets (see FIG. 1) before the severing table 1 travels outwards and adheres to this sheet due to the suction effect. The suction effect may be created by depressions in the bottom surface of the piston 46, in which depressions a negative pressure is produced. As soon as the sheet 15 adheres to the piston 46, the latter is pulled upwards to an extent sufficient for the severing table 1 to be able to slide below the sheet 15. After the severing table has been driven out fully, the sucking action is eliminated and the sheet is therefore set down on the severing table.

Several suction devices 13 may be available and raise the whole sheet to such an extent that the table 1 can slide in under this sheet. It will in most cases be sufficient, however, to raise only one edge zone of the sheet 15 above the table through one suction device 13 or a few suction devices 13 arranged at this edge zone of the sheet, as an outwards travel of the table the latter then pushes the remaining portions of the sheet upwards automatically on to the severing table 1.

When the severing table now returns into the punching zone and is raised upwards according to FIG. 3, it therefore carries on its upper surface the unpunched sheet 15 or 2, when the starting position of FIG. 1 is again achieved.

Thereafter the supplying of sheets can again be taken up and be continued until the desired number of sheets or the desired height of the stack is achieved, whereupon in accordance with FIG. 2 the severing table again travels to the left and the formed stack 18 is either set down on the pallet 17, or, if there is already a stack 18 on the latter, see FIG. 4, the newly formed stack is set down on the stack 18, a supporting unpunched sheet being interposed between the two stacks then available.

This procedure can be repeated a few times, so that there is finally a stack 18 in which several unpunched supporting sheets are arranged.

It is preferable to place another unpunched sheet 2 or 15 on the stack 18 before the latter is carried away, and this can take place by the severing table, after acceptance of a sheet 15 and return to its position shown in FIG. 4, again travelling to the left and thus leaving the sheet 15 behind and setting it down on the stack 18.

Now the stack 18, strengthened by a lower and an upper unpunched sheet and perhaps by intermediately-disposed unstamped sheets can be conveyed to further application or be packed.

FIG. 1 illustrates apparatus for adjusting sheet supporting element 68 to receive sheets of different widths. Supporting element 68 includes an end wall 69 which is shown to be adjustable between the solid-line position 69 and the dotted-line position 69*a*.

In order to reduce the friction between the severing table and the supported stack for moving the separating table out to the left, it may be desirable to form an air cushion by known ball valves at the upper surface of the severing table. The ball valves operate in the manner that a ball projecting slightly above the plane of the severing table closes an air valve if there is no material on the surface. If, however, sheet material is set down on the surface, then this presses the ball downwardly to such an extent that it no longer protrudes above the plane, the ball being removed from the valve seat and enabling the leakage of air which raises the sheet material with formation of an air cushion to such an extent that the friction between the stack of sheets and the table surface is very slight. The severing table surface areas becoming free as the table travels outwards then again release the balls whereby the latter close the valves and prevent an undesired leakage of air.

The finished stacks have usually a maximum height of 1.50 m. As with such a height the resilience of the stack is already so great that there is no longer any possibility of there being a sufficient counteracting force on the separation by the spreader fingers 7, it is also desirable for this reason to form the stack built up on the pallet of several stack portions each of a height of, for example, about 15 to 20 cm, at most 30 cm.

Certain parts of the apparatus can be adjusted in order to be able to handle sheets of different sizes. For example the ledges 12 and the appertaining supplementary panel 11 can be moved to the right if instead of the sheet width shown in FIG. 2, for example, sheets are to be stacked which occupy the full width of the pallet. In the same way the suction device 13 and the stop for the stack 14 would then be adjustable.

With the apparatus according to the invention a completely standard delivery operation can be achieved if the holding-back panel 10 and the suction device 13 are tilted away, as is shown in FIG. 1 in dot-dash lines. The severing table 1 then operates like a run-out table, especially when the friction is reduced by means of the air-cushion arrangement. The stack may then be pushed manually out of the stacking device. This is advantageous for many applications.

With the use of the customary wooden pallet the table 1 gives rise to protection of the cutting-off tools in relation to the pallet, which being of wood, and usually not particularly carefully treated, could have projecting splinters and the like which get into the cutting-off tools in the case of the usual known severing apparatus and could damage the tools. A futher danger is that such projecting parts of a damaged wooden pallet could also damage in particular the very quickly moving gripping device, if the table 1 were not available as severing and intermediate carrier.

The hold-back panel 10 and supplementary panel 11 may be produced from sheet metal, but the use of stretched fabrics is preferred.

As tests have shown, the method according to the invention for severing and stacking the sheets not only makes possible a higher operating speed (in the case of the known apparatus the handling of 5000 sheets per hour is possible, in the case of the punching device co-operating with the novel severing and depositing apparatus the handling of 7000 sheets per hour), but through the shorter turn-off times in accordance with the new method, the number of sheets falling out per stack formation is smaller. While there are about 100 sheets per stack with the known machine, there are only 30 sheets with the apparatus according to the invention despite the higher operating speed. Because of this the apparatus in accordance with the invention operates substantially more economically than has hitherto been possible.

In addition, there is the remarkably small increase in frontage which is required for the apparatus according to the invention. The present machine is only one half meter longer in relation to an apparatus without the particular stacking device. In comparison therewith, an increase of 50 to 60% of the total frontage would be necessary, if a stacking device of known kind had to be used.

I claim:

1. A method of separating and stacking sheets of paper, cardboard and the like, which are delivered from a sheet punching machine and consist of useful and waste portions connected together by small fillets, comprising the steps of (a) laying and separating a specific number of sheets on a severing table of a useful portion separating station;

(b) interrupting the supply of sheets;

(c) lowering the table with a stack of separated sheets;

(d) withdrawing the table from under the stack and laying the stack on a pallet situated therebelow;

(f) setting the table in place and raising same;

(g) removing the pallet with the stack and introducing a new pallet with simultaneous continuation of the procedure in method step (a).

2. A method as set forth in claim 1, comprising laying an unpunched sheet on the table before raising the table (method step (e)).

3. A method as set forth in claim 2, in which during a specific number of method cycles (method steps (a) to (g)) the pallet with the stack is not moved away during the method step (g).

4. A method as set forth in claim 3, comprising laying an unpunched sheet on the table before commencing the cycle of steps (a) to (g).

5. A method as set forth in claim 4, in which the method ends after at least one complete cycle (steps (a) to (g)) together with the further steps (a), (b), (c), (d), (e) in the following putting the table with the unpunched sheet into place above the stack;

withdrawing the table from under the unpunched sheet; and removing the pallet with the stack.

6. A method of stacking sheets of paper, cardboard and the like, which are delivered from a sheet punching machine and which consists of useful and waste portions connected together by small fillets and, separating said sheets to form separate stack portions, comprising the steps of:

(a) supplying punched, but not yet separated, sheets onto a severing table;

(b) severing said sheets into sheet portions to form separate stack portions; and (c) depositing said separate stack portions onto a stacking surface after withdrawing said severing table from under said separate stack portions.

7. A method in accordance with claim 6 wherein the step of depositing said separate stack portions includes the steps of lowering said severing table to a discharge position and withdrawing said severing table from under said separate stack portions so that said separate stack portions are deposited on said stacking surface.

8. A method in accordance with claim 6 further including the step of lowering said severing table as the height of said stack portions increases.

9. A method in accordance with claim 6 wherein the step of depositing includes the step of laterally displacing said severing table to a first position laterally displaced from said stacking surface while said separate stack portions are held in position above said stacking surface and returning said severing table into position above said separate stack portions after the latter are deposited on said stacking surface.

10. A method in accordance with claim 6 wherein said stacking surface is formed by a pallet, and further including the step of removing said pallet with said separate stack portions and replacing said pallet with a new pallet.

11. A method in accordance with claim 6 further including the step of interrupting the supply of sheets during said depositing operation.

12. A method in accordance with claim 6 further including the step of depositing an unpunched sheet on said severing table before receiving said punched sheets.

* * * * *